US005154069A

United States Patent [19]

Speetjens et al.

[11] Patent Number: 5,154,069

[45] Date of Patent: Oct. 13, 1992

[54] KNITTING NEEDLE HAVING FORCE REDUCTION PORTION

[75] Inventors: Joseph Speetjens, Greensboro, N.C.; Philip Champagne, Nun's Island, Canada

[73] Assignee: Exeltor Inc., Bedford, Canada

[21] Appl. No.: 758,126

[22] Filed: Sep. 12, 1991

[51] Int. Cl.[5] ..... D04B 35/04

[52] U.S. Cl. ..... 66/121; 66/123

[58] Field of Search ..... 66/121, 123

[56] References Cited

U.S. PATENT DOCUMENTS

| | | | |
|---|---|---|---|
| 3,464,237 | 8/1967 | Kohorn . | |
| 3,712,082 | 6/1971 | Kohorn . | |
| 3,874,199 | 4/1975 | Mayer et al. . | |
| 3,875,767 | 4/1975 | Kopal et al. . | |
| 3,994,145 | 11/1976 | Stetz . | |
| 4,068,500 | 1/1978 | Kohorn . | |
| 4,089,192 | 5/1978 | Kohorn . | |
| 4,452,053 | 6/1984 | Egbers et al. . | |
| 4,612,785 | 9/1986 | Smith et al. | 66/123 X |
| 4,625,527 | 12/1986 | Fukuhara | 66/123 |
| 5,097,683 | 3/1992 | Schüler et al. | 66/121 |

FOREIGN PATENT DOCUMENTS

| | | | |
|---|---|---|---|
| 1146765 | 5/1983 | Canada . | |
| 2408567 | 2/1974 | Fed. Rep. of Germany . | |
| 2753784 | 6/1978 | Fed. Rep. of Germany . | |
| 0208381 | 5/1984 | German Democratic Rep. | 66/121 |

OTHER PUBLICATIONS

H. Kraus, J. Speetjens and D. Virgilio Factors Contributing to Hook Failure of Latch Needles in Weft Knitting Dec. 1975.

Groz-Beckert—Advertisement of Needles of High Precision.

Terrot—Perfect Eightlock Technique I3P 148 and I3P 172.

Mayer & Cie.—Circular Knitting Machines for Knitted Body-Width Fabrics—Rib Structures Interlock Single Jersey—Sep. 1979.

Orizio J¼—Single Knit Machine.

Bernard Schuler, Albstadt-Ebingen—Knitting on Circular Machines with High Capacity Latch Needles.

Article from Melliand Textilberichte, Oct. 1987, pp. 733-735.

Petrow et al., Der Einfluss der Stosswelle auf die Zerstorung des Hakens der Zungennadel, Tetil-Praxis 1961, pp. 261-265.

*Primary Examiner*—Werner H. Schroeder
*Assistant Examiner*—John J. Calvert
*Attorney, Agent, or Firm*—Robert H. Barrigar

[57] ABSTRACT

A knitting needle of the type used in industrial knitting machines is provided in the shank, typically distally of and adjacent the driving butt, with a bow-spring portion acting as a shock absorber for the needle during its acceleration and deceleration. The bow-spring portion is stabilized on either longitudinal side thereof by shank portions aligned with the transverse dimensional boundaries of the shank. The convex limit of the bow-spring is spaced from the opposed transverse dimensional boundary by a distance sufficient to enable the spring to flex transversely under compression without reaching the transverse boundary. This structure facilitates high-speed operation of the needle and tends avoid fatigue failure of the hook.

12 Claims, 2 Drawing Sheets

KNITTING NEEDLE HAVING FORCE REDUCTION PORTION

FIELD OF THE INVENTION

The invention relates to knitting needles of the sort used in industrial knitting machines.

PRIOR ART

As knitting machine speeds have increased, there has been an increasing tendency for the needles or knitting tools used in such machines to break. Because of the reciprocating motion of the needles at high speed, there is a risk of breakage as a result of vibrations; it has also been recognized that because of the very rapid reciprocating motion, the stresses on the needle are severe and can cause breakage.

Because the greater the mass of the needle, the greater the stress imparted to the needle during acceleration and deceleration during reciprocation, it has been recognized that it is desirable to reduce the inertial mass to the extent possible consistent with maintaining structural integrity. To this end, it has been previously proposed that such needles be provided with a scalloped or wave-like configuration for the purpose of reducing the mass of the needle. Examples appear in the article "Factors Contributing to Hook Failure of Latch Needles in Weft Knitting", H. Kraus et al., 45 Textile Research Journal 853 (December, 1975), and in U.S. Pat. No. 3,994,145 (Stolz, 30 Nov., 1976).

Needle configuration for use in high-speed knitting machines have in recent years been chosen to avoid vibration, on the hypothesis that vibration is primarily responsible for needle failure at high speeds. Fatigue failure of the needle hook has been particularly difficult to overcome.

SUMMARY OF THE INVENTION

Since a knitting machine needle is not completely free to move, but rather is given support by the trick and cam block (needle slot) in the machine, we think that vibration is only a secondary problem; the main problem is the necessity of absorbing the internal needle stresses caused by rapid acceleration and deceleration of the needle during its reciprocating motion. Since such knitting needles are typically manufactured by stamping and consequently, may be subject to flaws that can permit the steel of which the needle is typically made to yield in response to rapid acceleration and deceleration, it follows that the prior objective of reducing the inertial mass of the needle is laudable. However, in order to optimize machine speeds and to minimize the risk of failure, we think that it is necessary not merely to reduce the mass of the needle but also in the design of the needle to provide some means for absorbing the shock imparted to the needle as a result of the rapid acceleration/deceleration reciprocal motion.

To this end, we have found that an advantageous needle design is obtained if a portion of the needle shank is formed as a bow-spring or arc-spring that in tension tends to extend longitudinally and in compression tends to bulge or bow transversely. The spring action of this shank segment thus permits internal stresses caused by acceleration/deceleration of the inertial mass of the needle to be absorbed without undue stressing of the steel of the needle at points of weakness. Thus, the shock of the reciprocal motion is borne by the spring formed in the needle itself.

In order for a needle according to this design to work properly, it is obviously necessary that the bow-spring portion of the needle be able to bulge in compression (in a transverse sense) without striking the walls of the needle slot in the knitting machine. Consequently, there should in the rest position of the needle be an adequate space formed between the needle slot wall and the convex edge of the spring portion of the needle facing the wall. Preferably the ends of the spring portion are formed near one outer transverse limit of the broader transverse dimension of the needle (which is limited, of course, by the dimensions of the needle slot within which the needle reciprocates). The maximum transverse extension of the convex edge of the curved shank portion is preferably spaced from the other transverse dimensional limit by about one-third of the total broad transverse dimension of the needle (i.e., one-third of the shank height).

One or more such bow-spring portions can be provided. They may be provided in bridges or otherwise in sequence or separated from one another. They need not be formed as arcs of circles; the curvature could be parabolic, hyperbolic or irregular, or formed as a series of straight-line segments. The bow-spring portion need not be formed of material of uniform dimensions; it can be thickened over a part of its curvature in accordance with preferred spring design and material strength principles. Preferably, the spring is located adjacent the driving butt immediately distally thereof. If there is also a selecting butt present a bow-spring could be located between the selecting butt and driving butt.

In order that the spring function to best advantage, its length in a longitudinal sense should preferably exceed its transverse width (in the broad transverse dimension of the needle) and should be at least equal to the shank height. Optimally, the longitudinal length of the curved spring portion is at least about twice the broader transverse dimension of the shank. Some spring action will advantageously occur if the bow-spring portion is shorter than this, but the shorter the bow-spring portion, the less likely it is to behave as an effective bow-(arc)-spring. On the other hand, if the curvature is extremely gentle, the bow-spring portion will tend to act more like a column than like a bow-spring, so that extreme should be avoided also. When the curvature is relatively smooth and the length of the spring is of the order of 2 to 3 times the transverse width of the needle, and the transverse distance between the transverse dimension limit at the ends of the spring and the point of maximum "bulging" of the spring in its rest position is about two-thirds the total broad transverse dimension of the needle (i.e. about two-thirds the shank height), the result tends to be about optimum. Another way to express the preferred curvature is to require the angle to the longitudinal axis made by the spring end to lie in the range about 10° to 50°. In order to increase the springiness of the needle, rather than try to increase the length of any one bow-spring portion of the shank, it is best to add further curved portions elsewhere along the shank.

All the figures of the drawings, in addition to being schematic in character, are enlarged. Typical transverse dimensions of industrial knitting needles (apart from the butt) do not exceed half a centimeter.

DETAILED DESCRIPTION WITH REFERENCE TO THE DRAWINGS

Figure 1:
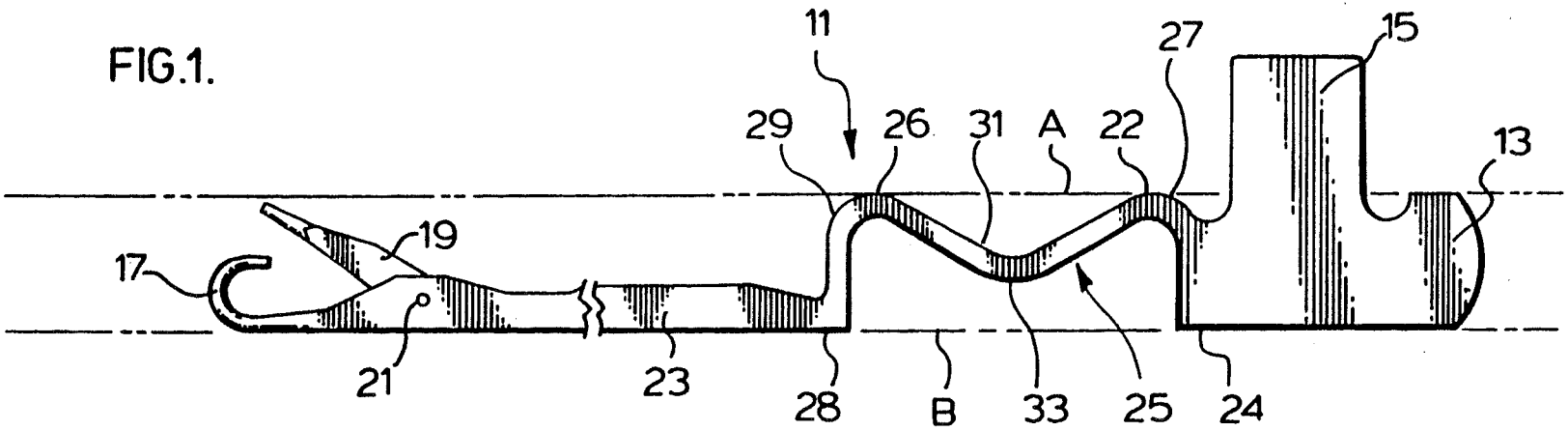
FIG. 1 is schematic profile view of a knitting needle constructed in accordance with the principles of the present invention.

In FIG. 1, a knitting needle 11 of the general type used in conventional industrial knitting machines is shown in profile. It is conventional to manufacture such needles by stamping steel of a thickness which is slightly narrower than the narrow dimension of the needle slot in which the needle is constrained to move. The broader transverse dimension of the needle is the distance between broken lines A and B whose spacing, of course, is determined by the broad transverse distance between the associated walls of the needle slot (not shown) in which needle 11 moves. There should, of course, be sufficient clearance between the needle and the needle slot that the needle 11 is free to reciprocate within the needle slot.

The proximal end 13 of the needle 11 is provided with a driving butt 15, which engages cams (not shown) in the knitting machine (not shown) so that reciprocal motion may be imparted to the needle 11 by the cams of the knitting machine. The distal end of needle 11 is formed as a hook 17 for which a pivoting latch 19 may be provided in a suitable pivotable mounting 21. The design details of the hook 17, the blade 23, the butt 15 and the proximal end 13 of the needle are extraneous to the teachings of the present invention.

The present invention is concerned with the provision of an arc-spring (bow-spring) segment as an integral part of the needle. In FIG. 1, this segment, generally indicated as 25, is located distally of the butt 15 in the shank 23 of needle 11, i.e. in the portion of the needle between the butt 15 and the blade 23 of the needle.

In FIG. 1, such bow-spring portion or segment 25 is formed as a double reverse curved portion, extending between a proximal terminating curved portion 27 and a distal terminating curved portion 29, whose uppermost boundaries, as seen in FIG. 1, are aligned with one transverse boundary A of the broad transverse dimension (shank height) of the needle 11. (Herein the transverse dimension is considered as excluding the butt). Between end curved portions 27 and 29 of the curved shank portion 25 is a central bow-spring curved portion 31, which is capable of flexing in response to the reciprocal motion of the needle 11, which places the bow-spring 31 alternately into tension and compression.

In tension, the bow-spring 31 tends to flatten or extend longitudinally. This, of course, will happen without interference in any way with the guide walls of the needle slot, since such motion of the bow-spring portion 31 will not tend to place any portion of the needle 25 outside the broad transverse boundaries A and B.

On the other hand, under compression, the point 33 of maximum bulging on the convex edge of bow-spring 31 will tend to move transversely in the direction of opposing broad transverse dimension boundary B. If the compression were sufficiently severe, or if the thickness of the spring portion 31 were too small, or if the point 33 were chosen to lie too close to boundary B, then there might be a risk that under maximum compression, point 33 would extend beyond boundary B of the broad transverse dimensional limit of the needle 11. Consequently, the shape and dimensions of the spring portion 31 must be chosen so that this risk does not materialize; i.e. so that point 33 never extends beyond boundary B. This can be achieved if the spring 31 is of a thickness that is comparable to that of the blade 23 generally; the thickness of the spring material can be made somewhat smaller in dimension than the dimension of most of the blade 23 in order to improve its springiness if the overall design desiderata so require. The choice will depend upon the shape of the bow-spring, thickness of the material from which the needle is stamped, the strength of steel employed in the needle, the length and mass of the blade and distal end of the needle, and the shape and configuration of the blade and distal portion of the needle in question.

Further, it is desirable generally that the distance between end portions 27 and 29 of the curved shank portion 31 should be at least about twice the broad transverse dimension of the needle 11, i.e. twice the distance between transverse boundaries A and B.

Finally, it is desirable that the point of maximum protrusion 33 of the bow-spring portion 31 should be distant from boundary B by a least about one-third of the total broad transverse width (shank height) of the needle 11, i.e. about one-third of the distance between boundary lines A and B.

Note that as the bow-spring portion 31 flexes, there could be a tendency for the needle to distort from its preferred longitudinal alignment. To prevent this, the needle should be supported within the needle slot on both sides of the bow-spring. Such support should be provided at both broad transverse dimensional limits A, B. It can be readily seen that points 22, 24 fulfill this objective to the right of the bow-spring portion 31 as seen in FIG. 1, while points 26, 28 provide similar such support on the left of the bow-spring 31.

Figure 2:
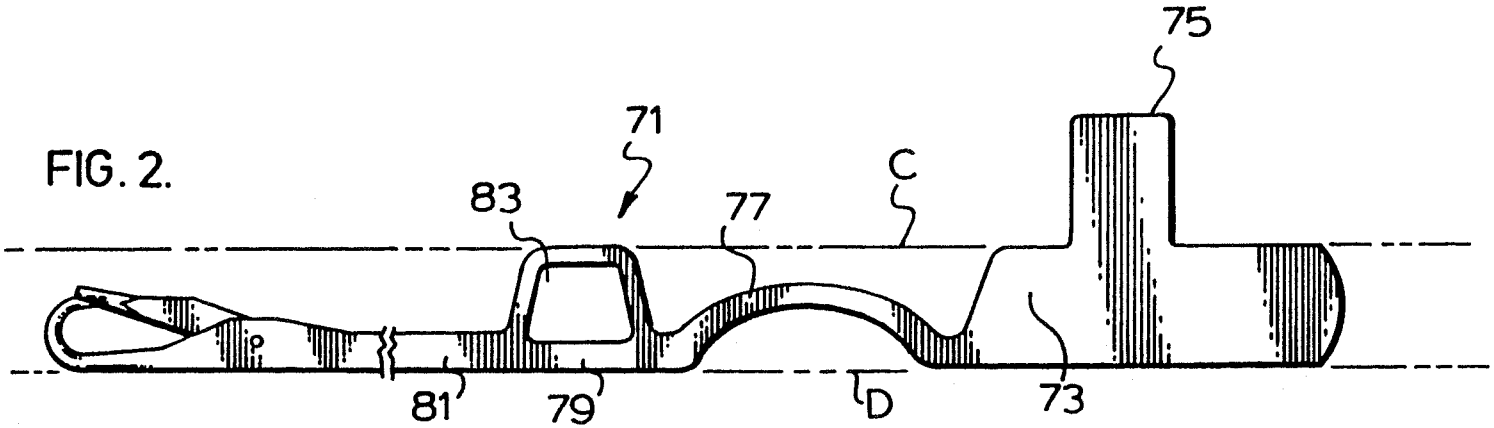
FIG. 2 is an alternative schematic needle profile constructed in accordance with the principles of the invention and in which the bow-spring portion is curved in the sense opposite to that of FIG. 1.

FIG. 2 illustrates an alternative needle design in accordance with the principles of the invention, in which the bow-spring is configured within the needle in a manner somewhat different from the configuration illustrated in FIG. 1. Needle 71 of FIG. 2 comprises a shank section 73 in which a butt 75 is integrally formed. The shank 73 continues in an arc or bow-spring section 77, which is curved in an upwardly convex sense (which is exactly opposite to the sense in which the bow-spring 31 of FIG. 1 is configured). Continuing toward the distal end of the needle, a stabilizer section 79 is provided from which the needle blade 81 continues distally. Stabilizer section 79 is cut out at 83 to minimize the mass of the needle distally of the shank 73. The stabilizer portion 79 meets the upper and lower (as seen in FIG. 2) transverse boundaries C and D of the needle 71, and thus stabilizes the needle 71 within the needle slot of the knitting machine for which it is designed. The presence of stabilizing section 79 tends to maintain blade 81 of the needle in proper longitudinal alignment, notwithstanding flexion of the bow-spring portion 77.

Figure 3:
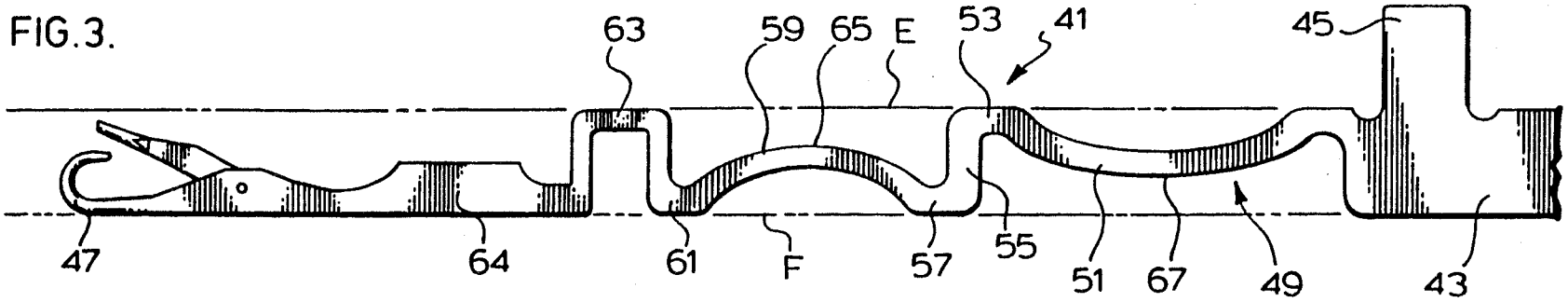
FIG. 3 is a schematic profile view of an alternative knitting needle design constructed in accordance with the principles of the present invention, in which two bow-springs are formed.

Enough bow-spring action may be imparted to the needle by the provision of one spring portion such as bow-spring 25 of FIG. 1 or bow-spring 77 of FIG. 2, but in some cases more shock absorbtion may be required, and in that event one or more additional spring sections can be added. FIG. 3 shows an alternative needle construction in conformity with the principles of the present invention in which two bow-spring portions are present, arranged in longitudinal sequence distally of the driving butt of the needle.

Specifically, a needle generally indicated as 41 is provided at its proximal end 43 with a butt 45 functioning as does the butt 15 of the needle 11 of FIG. 1. The distal end 47 of the needle 41 can be formed in conventional manner and will not be further described.

Immediately adjacent the butt 45 is a bridge portion 49 of the shank of needle 41, which is formed as a gently curved bow-spring 51 functioning in essentially the same manner as the bow-spring 31 of FIG. 1. Distally the bow-spring 51 terminates in a flattened upper support portion 53 (as seen in FIG. 3) which continues as a transverse cross-piece portion 55 whose distal portion continues as a flattened end portion 57 of a second bow-spring portion 59 protruding in exactly the opposite sense to the sense of protrusion of bow-spring 51.

In some knitting needle jargon, the bow-spring 59 might, if it were longitudinally straight instead of curved, be referred to as a "plateau". However, the term "plateau" is perhaps not apt as applied to a bow-spring.

At the distal end 61 of bow-spring 59 is a rectangular arch portion 63 from which the blade 64 of the needle 41 projects longitudinally. Rectangular arch portion 63 functions as a stabilizing section for the blade 64 of needle 41 extending distally therefrom. It serves essentially the same function as the stabilizer section 79 of FIG. 2.

It can be seen that the entirety of the structure of needle 41, distally of the butt 45, is confined between broad transverse boundary limits E and F. Furthermore, it can be seen that the respective ends of each of the bow-springs 51 and 59 is aligned with a respective one of these boundary limits. The bow-spring 51 ends are aligned with boundary limit E and those of bow-spring 59 are aligned with boundary limit F. Further, on each side (in a longitudinal sense) of each of the bow-springs, there is formed in the needle a support portion aligned with each of the broad transverse dimensional limits E, F, thereby to maintain longitudinal alignment of the structure.

It can be seen that the point 65 of maximum protrusion of bow-spring 59 in the direction of transverse dimensional boundary E still leaves a space of about one-third the total broad transverse dimension of needle 41 between point 65 and transverse boundary E. In the case of the bow-spring 51, which is longer in extension then bow-spring 59 and more gently curved, the distance between the point of maximum protrusion 67 and boundary limit F is somewhat greater than one-third, which is consistent with the longer length and shallower curvature of the bow-spring 51. It may be desirable, where more than one bow-spring is employed in a needle, to have the bow-springs of different lengths and curvatures so as to avoid unwanted resonance at certain frequencies of reciprocation.

Note that while support points 22 and 26 of FIG. 1 are rounded, the counterpart support points of FIG. 3 are flat. The latter is preferred as offering improved longitudinal structural stability.

Figure 4:
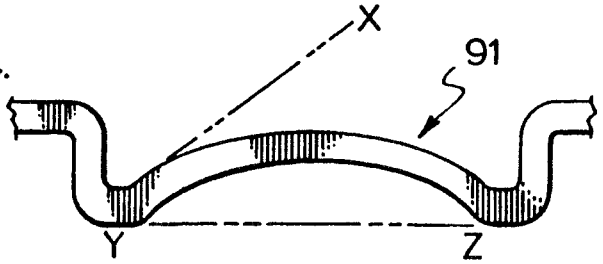
FIG. 4 is a schematic representation of a bow-spring segment of a knitting needle, constructed in accordance with the invention.

FIG. 4 illustrates a representative bow-spring section of a knitting needle. The section, generally indicated as 91, has an initial and maximum angle of inclination relative to the longitudinal axis shown as the angle XYZ in FIG. 4. The angle XYZ should preferably lie between about 10° and 50°. If the angle XYZ is below about 10°, the bow-spring will tend to function too much as a column and too little as a spring. Above about 50°, the bow-spring 91 does not flex as easily as is desirable to obtain optimum stress relief for the blade of the knitting needle.

Figure 5:
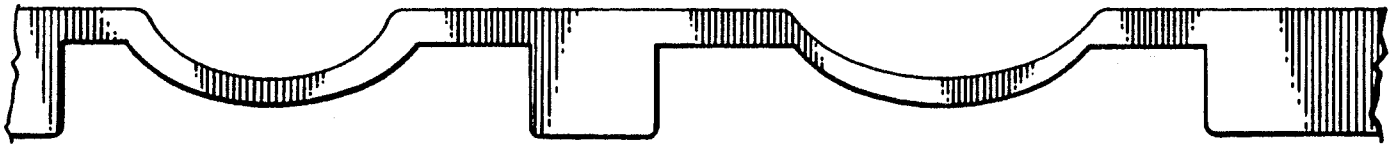
FIG. 5 is a schematic depiction of two alternative bow-spring configurations for possible use in a needle in accordance with the invention, illustrating the possibility of variation of thickness of the bow-spring portion over its arcuate extension.

FIG. 5 is a schematic fragment profile view of a hypothetical knitting needle illustrating that the bow-spring segment need not be of uniform thickness throughout, but could be narrower in the centre then at the ends (as in the left hand portion of the figure) or thicker in the centre section then at the ends (as in the right hand portion). This is not to suggest that any actual needle would be made in accordance with the geometry of FIG. 5; the figure is there for schematic purposes only, to illustrate the point that the bow-spring thickness can change over its arc of extension. Note that the shank in the areas of (integral) connection of the ends of the spring to the rest of the shank should not be designed as weak points; thus the narrow dimension of the right-hand bow-spring must be wide enough to avoid failure.

Although the terms "bow" and "arc" have been used to describe the spring, it may be configured as other than a smooth curve. It could be formed as a series of straight-line segments angled slightly with respect to one another, for example.

Although in the drawings the bow-spring has been shown as located distally of the driving butt, there may in some needles be a need for such a spring to be located proximally of the driving butt, where the needle also includes a selecting butt. In such case the spring would be located distally of the selecting butt.

The ambit of the invention is not limited to the specific embodiments illustrated and described with reference to the drawings, but is as defined in the appended claims.

We claim:

1. A knitting needle for use in industrial knitting machines, having a shank movable within a needle slot, and having means such as a cam-follower driving butt for imparting reciprocating motion to the needle, and a distal end provided with yarn-engaging means, a broader transverse dimension of the needle distally of the driving butt being limited by a corresponding transverse dimension of the needle slot; comprising at least one bow-spring portion formed as an integral part of the shank to lie in a plane formed by the longitudinal-broader transverse dimensions, the bow-spring portion intermediate ends thereof protruding in a direction of the opposed broad transverse dimensional limit of the shank, but remaining inset from the opposed transverse dimensional limit so as to permit the bow-spring portion under longitudinal compressive stress of the shank to flex in the direction of the opposed transverse dimensional limit, thereby to provide within the needle structure a spring that absorbs some shock imparted to the needle by force inducing reciprocating motion thereof.

2. A needle as defined in claim 1, wherein the ends of the bow-spring portion are proximate to the other of the broad transverse dimensional limits of the shank, 3. A needle as defined in claim 2, wherein structure-stabilizing portions of the needle on each side longitudinally of the bow-spring portion reach both transverse dimensional limits of the needle, thereby stabilizing longitudinal alignment of the needle.

4. A needle as defined in claim 3, wherein the bow-spring is located adjacent and distally of the driving butt of the needle.

5. A needle as defined in claim 4, wherein the bow-spring portion is continuously curved.

6. A needle as defined in claim 4, wherein the needle is formed by stamping.

7. A needle as defined in claim 6, wherein the distance between the maximum protrusion of the bow-spring portion and the opposed transverse dimensional limit of the shank is approximately one-third of the broader transverse dimension of the needle.

8. A needle as defined in claim 6, wherein the bow-spring portion has a length substantially exceeding a width of the portion in the broad transverse dimension.

9. A needle as defined in claim 8, wherein the longitudinal length of the bow-spring portion is at least twice the broader transverse dimension of the shank.

10. A needle as defined in claim 4, wherein the angle made by the ends of the bow-spring, relative to the longitudinal axis of the needle, lies within a range about 10° to 50°.

11. A needle as defined in claim 4, wherein distally of the spring and proximally of the blade there is formed in the needle a blade stabilizing portion having longitudinally extending edges substantially aligned with the transverse dimensional limits of the needle.

12. A needle as defined in claim 4, wherein the structure-stabilizing portions have flattened longitudinally extending edges aligned with the transverse dimensional limits of the shank.

* * * * *